US007497225B1

(12) United States Patent
Klein, Jr. et al.

(10) Patent No.: US 7,497,225 B1
(45) Date of Patent: Mar. 3, 2009

(54) MULTI-FUNCTIONAL UMBRELLA

(76) Inventors: Roland C. Klein, Jr., 601 Brookfield Dr., Centerville, MD (US) 21617; Mike Conn, 202 Pennick Dr., Stevensville, MD (US) 21666

( * ) Notice: Subject to any disclaimer, the term of this patent is extended or adjusted under 35 U.S.C. 154(b) by 8 days.

(21) Appl. No.: 11/699,965

(22) Filed: Jan. 30, 2007

Related U.S. Application Data

(60) Provisional application No. 60/762,996, filed on Jan. 30, 2006.

(51) Int. Cl.
*A45B 3/00* (2006.01)

(52) U.S. Cl. ..... 135/16; 135/118

(58) Field of Classification Search ..... 135/16, 135/20.1, 20.3, 188; 222/386.5, 401; 239/337, 239/355, 362, 363
See application file for complete search history.

(56) References Cited

U.S. PATENT DOCUMENTS

| | | | | | |
|---|---|---|---|---|---|
| 2,628,797 | A * | 2/1953 | Campomar | 248/545 |
| 4,867,187 | A * | 9/1989 | Divine | 135/16 |
| 5,029,239 | A | 7/1991 | Nesbit | |
| 5,098,057 | A | 3/1992 | Gran | |
| 5,143,108 | A | 9/1992 | Kenney | |
| 5,273,062 | A * | 12/1993 | Mozdzanowski | 135/16 |
| D347,319 | S * | 5/1994 | Friedman | D3/13 |
| 5,609,175 | A * | 3/1997 | Gerry et al. | 135/16 |
| 6,017,188 | A | 1/2000 | Benton | |
| 7,021,866 | B2 * | 4/2006 | Keefe | 405/244 |
| 2002/0078985 | A1 * | 6/2002 | Farr | 135/16 |
| 2003/0192579 | A1 * | 10/2003 | Llamas Garijo | 135/16 |
| 2005/0040297 | A1 * | 2/2005 | Saraf | 248/156 |
| 2005/0161066 | A1 * | 7/2005 | Ma | 135/16 |
| 2005/0161067 | A1 * | 7/2005 | Hollins | 135/16 |
| 2005/0211282 | A1 * | 9/2005 | DeVenezia et al. | 135/16 |

* cited by examiner

*Primary Examiner*—David Dunn
*Assistant Examiner*—Patrick Lynch

(57) ABSTRACT

A multi-functional umbrella includes a first rod and a collapsible canopy directly anchored thereto. A second rod is pivotally attached to the first rod, and a handle section is monolithically formed with the second rod and spaced from the first rod. A mechanism automatically penetrates the second rod beneath a ground surface. A mechanism broadcasts audio signals and is housed within the second rod and the handle section, and includes a radio and a speaker electrically coupled thereto. A mechanism discharges a predetermined quantity of fluid from the first rod. The automatic penetrating mechanism and the broadcasting mechanism and the fluid discharging mechanism are simultaneously and independently operable as desired by the user.

15 Claims, 7 Drawing Sheets

MULTI-FUNCTIONAL UMBRELLA

CROSS REFERENCE TO RELATED APPLICATIONS

This application claims the benefit of U.S. Provisional Application No. 60/762,996, filed Jan. 30, 2006, the entire disclosures of which are incorporated herein by reference.

STATEMENT REGARDING FEDERALLY SPONSORED RESEARCH OR DEVELOPMENT

Not Applicable.

REFERENCE TO A MICROFICHE APPENDIX

Not Applicable.

BACKGROUND OF THE INVENTION

1. Technical Field

This invention relates to umbrellas and, more particularly, to a self-standing multi-functional umbrella for providing user enjoyment during inclement weather conditions.

2. Prior Art

Beach umbrellas are widely used not only on the beach to provide shade from the direct light of the sun but also on other outdoor recreational places, such as the areas for the spectators of a sport and outdoor coffee shops, such that people sitting under them can be protected from the sun and rain. Beach umbrellas usually include a shank, several ribs radially spread out from the upper end of the shank, spreaders, which are pivoted to the middle portions of the ribs at the outer ends and pivoted to a slidable ring at the inner ends, and a canopy secured to the ribs.

One prior art example shows a beach umbrella with lamps that is provided with receiving trenches lengthwise on each of the ribs thereof, and the ribs each have several spaced through holes communicating with the trench. Several of the lamps are each connected to one of branches of a conductive wire. The wires are placed along the ribs, and the branches are each passed through one of the through holes with the wires and the lamps being arranged on two opposing sides of the ribs. When the trenches are formed on the bottom of the ribs, the lamps can be closely received in the trenches with most of the weight being supported by the wires held on the ribs, therefore the same can't possibly fall off even when the umbrella is being stretched or folded. Unfortunately, this prior art example does not provide means for misting or rinsing a user with water, and also does not provide an integrated audio system whereby a user can listen to music without having to carry an additional item.

Another prior art example shows a beach umbrella invention for facilitating height adjustment and storage. In one embodiment, the shank comprises an upper support tube and a lower sliding tube comprising a top fastening mechanism. The fastening mechanism including an eccentric, intermediate shaft, an eccentric groove around the shaft, and a stop on the eccentric groove, and an eccentric C-shaped locking device put on the eccentric groove. The locking device includes a stop block. In a sliding position, the stop and the stop block are opposite. Responsive to further rotating the sliding tube, the fastening mechanism, and the shaft about a half circle about the support tube, the stop is urged against the stop block, and an eccentric portion of the shaft and the stop urge against the locking device for biasing one side of the locking device against an inner wall of the support tube in a locked position. Unfortunately, this prior art example does not provide an auger with which a user can easily insert the umbrella into a ground surface. In addition, this prior art example also does not provide means for misting or rinsing a user with water, and also does not provide an integrated audio system whereby a user can listen to music without having to carry an additional item.

Accordingly, a need remains for a multi-functional umbrella in order to overcome the above-noted shortcomings. The present invention satisfies such a need by providing an apparatus that is convenient and easy to use, is lightweight yet durable in design, and provides user enjoyment during inclement weather conditions. Such an apparatus provides consumers with a fully functional beach umbrella which can be easily and securely stabilized in a ground surface. An easily activated auger bit drives the umbrella into a ground surface, effectively preventing the umbrella from toppling over or becoming lifted therefrom due to strong winds and eliminating accidents that occur when an umbrella is knocked over and the umbrella pole is exposed. An integrated mister allows a user to cool the body while spending long hours in the sun and heat. The mister can also rinse off a user body after emerging from sticky salt water, as well as rinse away sand, dirt, and other debris. An integrated AM/FM radio provides the sounds of favorite music without having to transport an additional item. The present invention is inexpensive, simple to use, and designed for many years of repeated use.

BRIEF SUMMARY OF THE INVENTION

In view of the foregoing background, it is therefore an object of the present invention to provide an apparatus for a multi-functional umbrella. These and other objects, features, and advantages of the invention are provided by a self-standing multi-functional umbrella for providing user enjoyment during inclement weather conditions.

The apparatus includes a first rod and a collapsible canopy directly anchored to the first rod. A second rod is pivotally attached to the first rod in such a manner that the canopy is rotatably pivotal about a fulcrum axis effectively defined orthogonal to the second rod. A handle section is monolithically formed with the second rod and advantageously spaced from the first rod, and has diametrically offset gripping portions extending perpendicularly away from the second rod.

The apparatus further includes a mechanism for automatically penetrating the second rod beneath a ground surface such that the first rod conveniently remains statically anchored at a fixed position during operating conditions. Such an automatic penetrating mechanism includes a motor housed within the handle section, and a power source electrically coupled to the motor. An auger is directly coupled to the motor and effectively extends vertically downward therefrom. A switch is conveniently disposed along an outer surface of the handle section. A protective cap is removably positioned over the auger for effectively shielding the auger during transport, and the auger is advantageously rotatable about a fulcrum axis defined along a longitudinal length of the second rod.

The apparatus further includes a mechanism for broadcasting audio signals housed within the second rod and the handle section. Such a broadcasting mechanism includes a radio and a speaker electrically coupled thereto.

The apparatus further includes a mechanism for discharging a predetermined quantity of fluid from the first rod. Such a fluid discharging mechanism includes a reservoir formed within the first rod and advantageously extending downwardly from an open top end of the first rod such that the top end effectively defines an inlet port for conveniently introducing water into the reservoir. A plurality of outlet ports is in fluid communication with the reservoir and disposed along a bottom end thereof. A protrusion is formed along an inner wall of the reservoir and at an entrance of the outlet ports, and is conveniently located above the outlet ports. A vertically displaceable stop member is linearly positioned within the reservoir and is selectively disengaged from the protrusion. An air pump is seated within the first rod and subjacent to the stop member, and an inflatable diaphragm is directly coupled to the air pump and removably abutted directly against a bottom surface of the stop member. The outer edge of the stop member is chamfered and effectively defines an arcuately shaped region that has a flexible diameter adaptable to a corresponding diameter of the protrusions for advantageously creating a water-tight seal therewith when the diaphragm is deflated. Such a diaphragm is selectively adaptable for receiving a volume of air therein.

The fluid discharging mechanism further includes a conduit directly coupled to the air pump and passing through the stop member. Such a conduit has a distal end terminating at a top surface of the stop member and within the reservoir. The air pump effectively causes the diaphragm to inflate and thereby elevates the stop member a predetermined vertical distance such that outer edges of the stop member advantageously disengage the protrusion and thereby conveniently allows the fluid to flow along a downward passageway into the outlet ports. The conduit introduces air into the reservoir and thereby effectively causes the fluid to rapidly discharge outwardly from the outlet ports for creating a mist. The automatic penetrating mechanism and the broadcasting mechanism and the fluid discharging mechanism are simultaneously and independently operable as desired by the user.

In operation, a method for employing a multi-functional umbrella to provide user enjoyment during inclement weather conditions includes the steps of providing a first rod, directly anchoring a collapsible canopy to the first rod, and pivotally attaching a second rod to the first rod in such a manner that the canopy is rotatably pivotal about a fulcrum axis defined orthogonal to the second rod, providing a handle section monolithically formed with the second rod and spaced from the first rod, and providing a mechanism for automatically penetrating the second rod beneath a ground surface such that the first rod remains statically anchored at a fixed position during operating conditions.

The method further includes the steps of providing a mechanism for broadcasting audio signals, and providing a mechanism for discharging a predetermined quantity of fluid from the first rod. The broadcasting mechanism is housed within the second rod and the handle section, and includes a radio and a speaker electrically coupled thereto.

The method further includes the steps of providing a reservoir formed within the first rod and extending downwardly from an open top end of the first rod such that the top end defines an inlet port for introducing water into the reservoir, providing a plurality of outlet ports in fluid communication with the reservoir and disposed along a bottom end thereof, and providing a protrusion formed along an inner wall of the reservoir and at an entrance of the outlet ports. The protrusion is located above the outlet ports.

The method further includes the steps of providing a vertically displaceable stop member linearly positioned within the reservoir and selectively disengaged from the protrusion, providing an air pump seated within the first rod and subjacent to the stop member, providing an inflatable diaphragm directly coupled to the air pump and removably abutted directly against a bottom surface of the stop member, and providing a conduit directly coupled to the air pump and passing through the stop member. The diaphragm is selectively adaptable for receiving a volume of air therein, and the conduit has a distal end terminating at a top surface of the stop member and within the reservoir.

The air pump causes the diaphragm to inflate and thereby elevates the stop member a predetermined vertical distance such that outer edges of the stop member disengage the protrusion and thereby allows the fluid to flow along a downward passageway into the outlet ports. The conduit introduces air into the reservoir and thereby causes the fluid to rapidly discharge outwardly from the outlet ports for creating a mist.

The method further includes the steps of providing a motor housed within the handle section, providing a power source electrically coupled to the motor, providing an auger directly coupled to the motor and extending vertically downward therefrom, and providing a switch disposed along an outer surface of the handle section. The steps further include removably positioning a protective cap over the auger for shielding the auger during transport, and rotating the auger about a fulcrum axis defined along a longitudinal length of the second rod. The automatic penetrating mechanism and the broadcasting mechanism and the fluid discharging mechanism are simultaneously and independently operable as desired by the user.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

It is noted the purpose of the foregoing abstract is to enable the U.S. Patent and Trademark Office and the public generally, especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

BRIEF DESCRIPTION OF THE SEVERAL VIEWS OF THE DRAWING

The novel features believed to be characteristic of this invention are set forth with particularity in the appended claims. The invention itself, however, both as to its organization and method of operation, together with further objects and advantages thereof, may best be understood by reference to the following description taken in connection with the accompanying drawings in which:

DETAILED DESCRIPTION OF THE INVENTION

Figure 1:
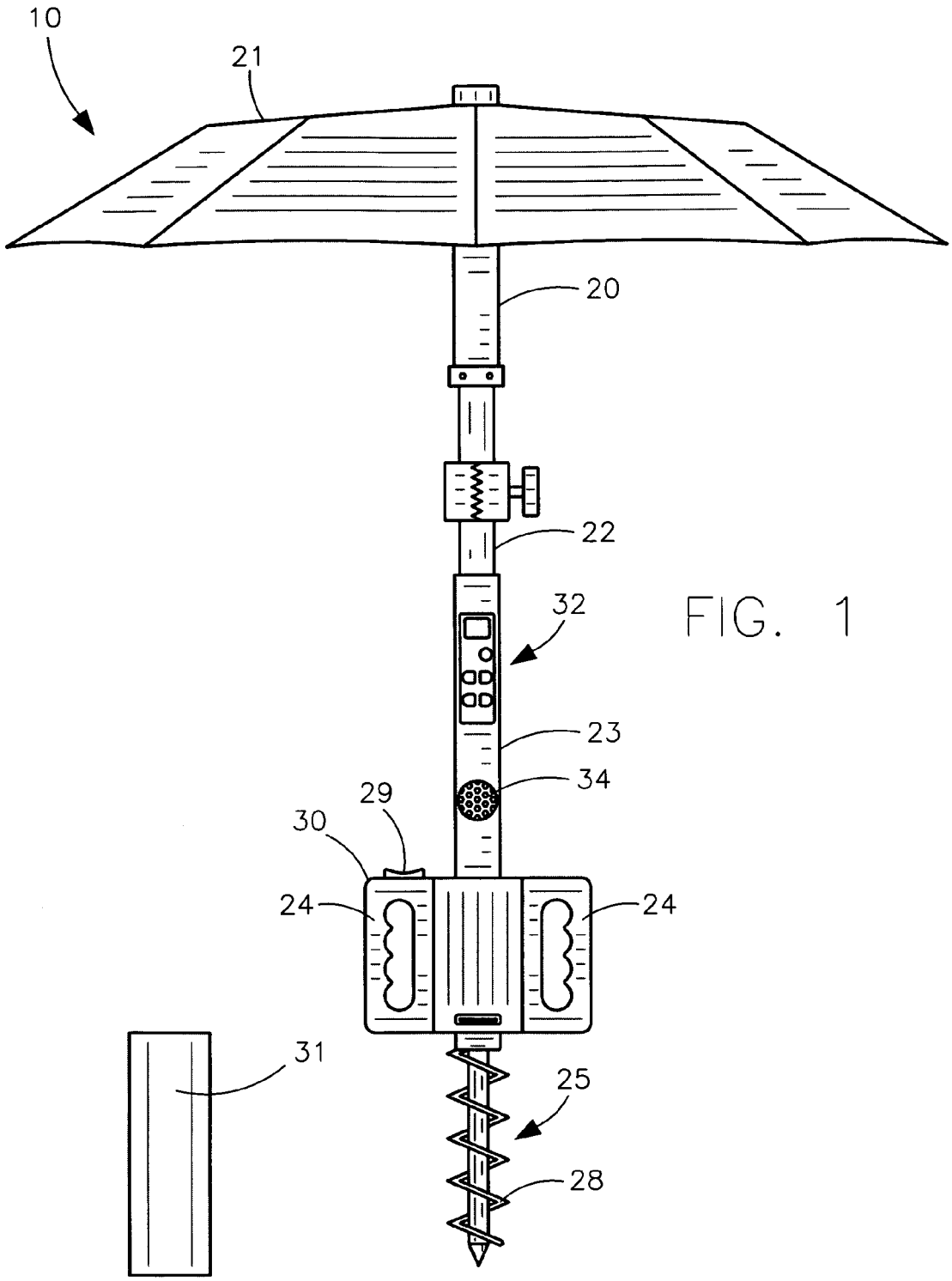
FIG. 1 is a front elevational view of a multi-functional umbrella, in accordance with the present invention.
Figure 2:
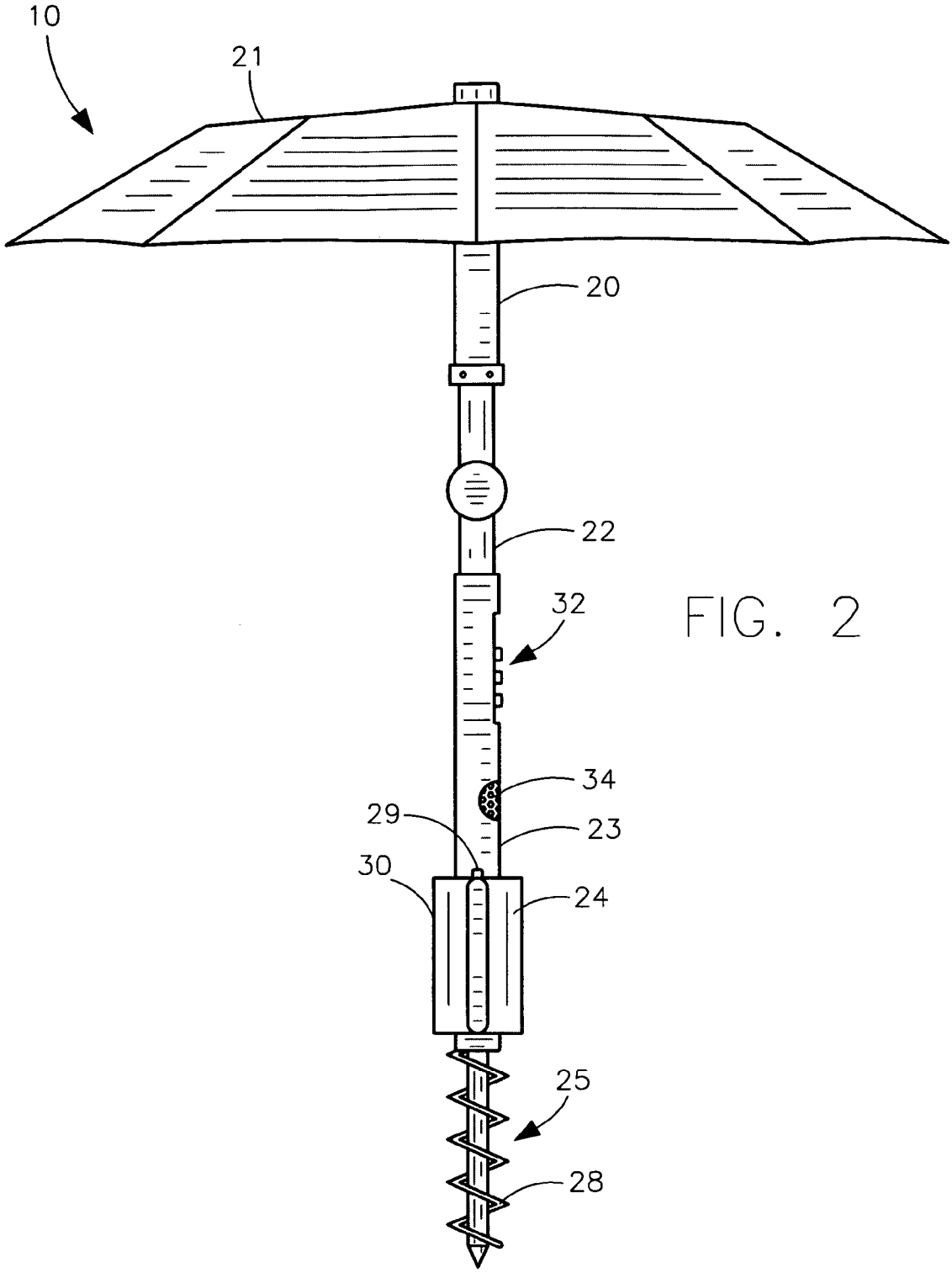
FIG. 2 is a side elevational view of the apparatus shown in FIG. 1.
Figure 3:
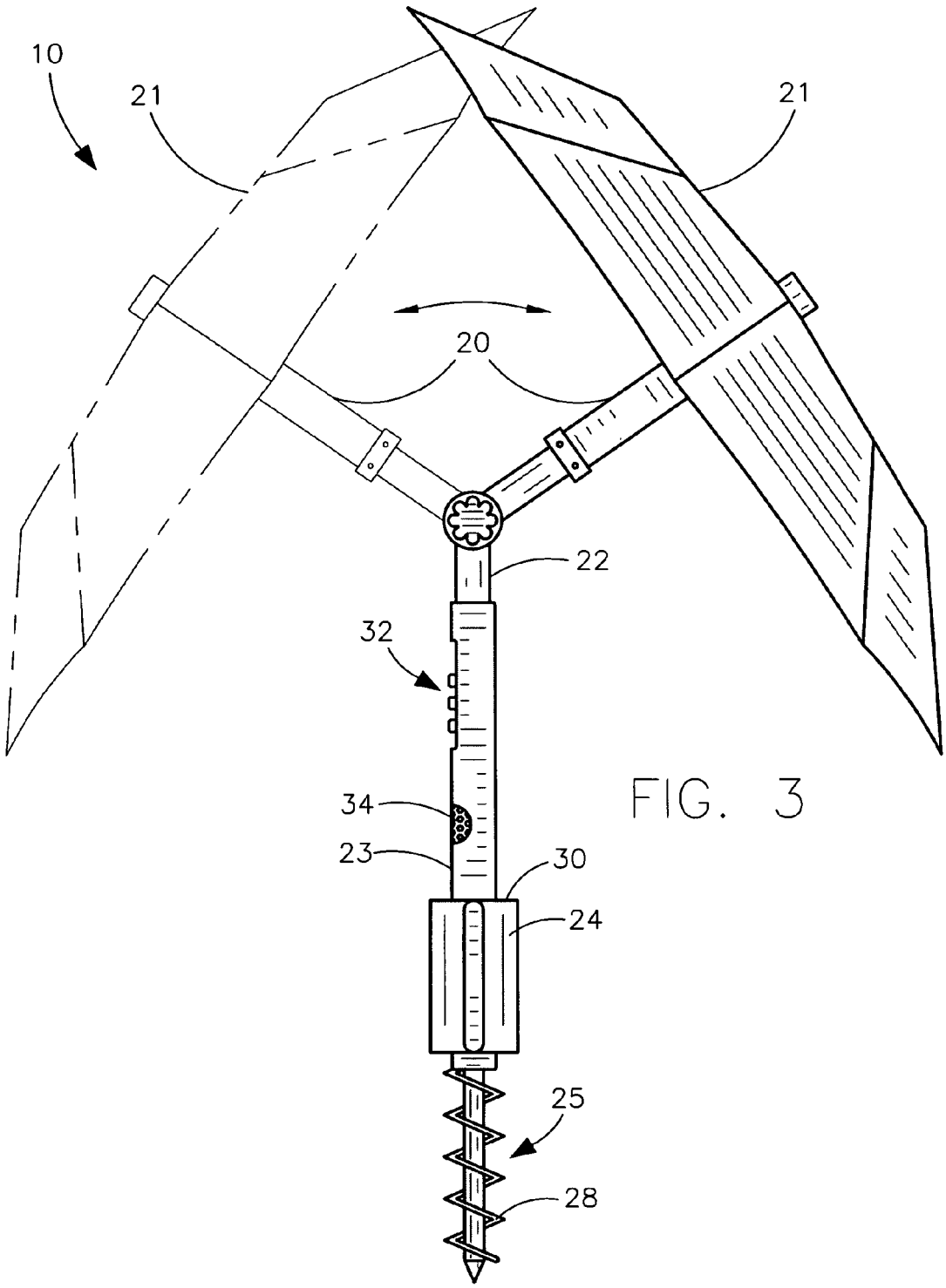
FIG. 3 is a side elevational view of the apparatus shown in FIG. 2, showing the canopy pivoted to alternate positions.
Figure 4:
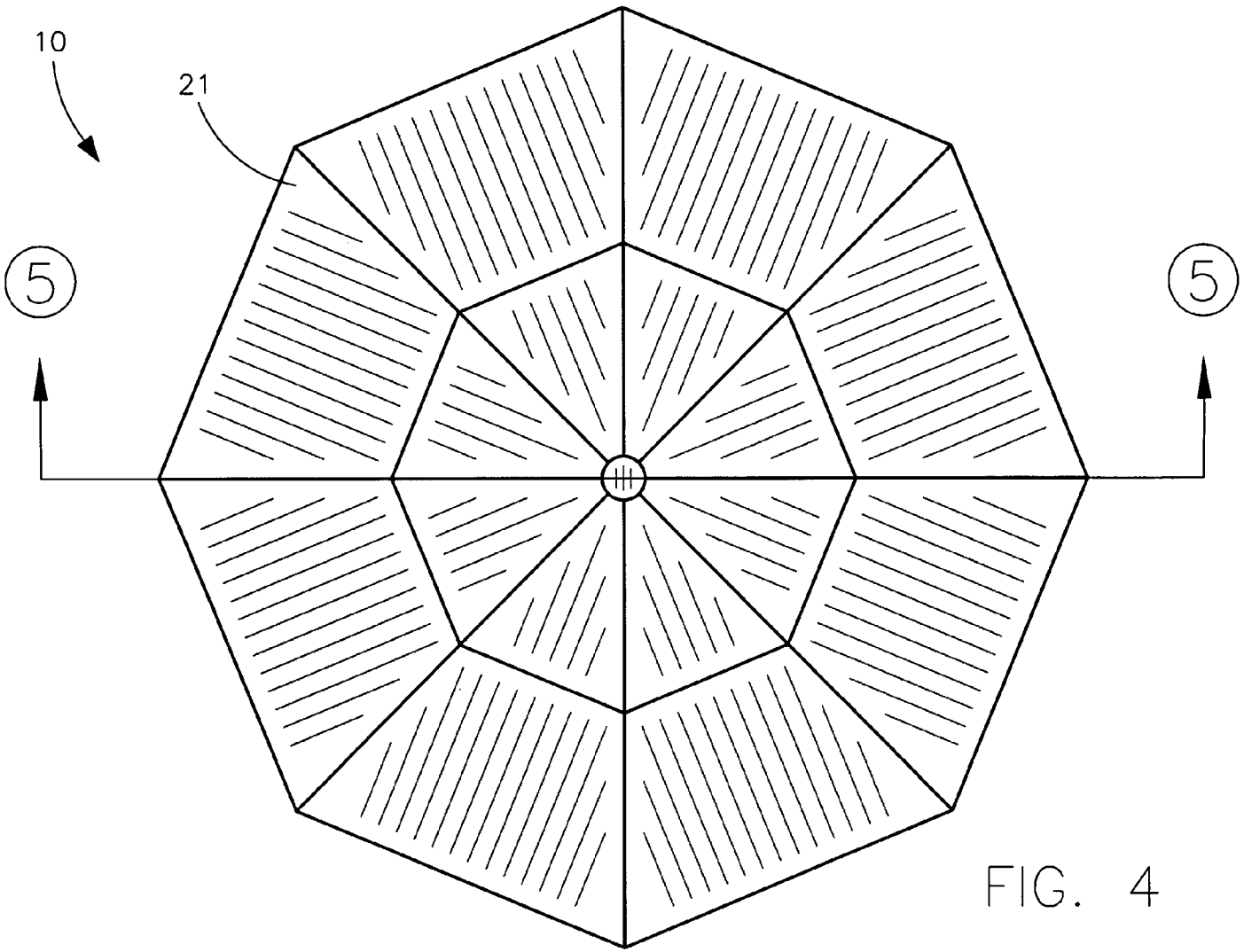
FIG. 4 is a top plan view of the apparatus shown in FIG. 1.

The present invention will now be described more fully hereinafter with reference to the accompanying drawings, in which a preferred embodiment of the invention is shown. This invention may, however, be embodied in many different forms and should not be construed as limited to the embodiment set forth herein. Rather, this embodiment is provided so that this application will be thorough and complete, and will fully convey the true scope of the invention to those skilled in the art. Like numbers refer to like elements throughout the figures.

The apparatus of this invention is referred to generally in FIGS. 1-7 by the reference numeral 10 and is intended to provide a multi-functional umbrella. It should be understood that the apparatus 10 may be used to provide shade, mist, and audio sounds in many different types of environments and should not be limited in use to providing shade, mist, and audio sounds in only those types of environments described herein.

Referring to FIGS. 1, 2, 3 and 5, the apparatus 10 includes a first rod 20 and a collapsible canopy 21 directly anchored to the first rod 20, without the use of intervening elements. A second rod 22 is pivotally attached to the first rod 20 in such a manner that the canopy 21 is rotatably pivotal about a fulcrum axis defined orthogonal to the second rod 22. The canopy 21 and first 20 allow a user to collapse the canopy 21 for transport and storage, and also bias the canopy 21 to a multitude of positions based on user desire during operating conditions. A handle section 23 is monolithically formed with the second rod 22 and advantageously spaced from the first rod 20, and has diametrically offset gripping portions 24 extending perpendicularly away from the second rod 22.

Again referring to FIGS. 1, 2, 3 and 5, the apparatus 10 further includes a mechanism 25 for automatically penetrating the second rod 22 beneath a ground surface, which is essential such that the first rod 20 remains statically anchored at a fixed position during operating conditions. Such an automatic penetrating mechanism 25 includes a motor 26 housed within the handle section 23, and a power source 27 electrically coupled to the motor 26. An auger 28 is directly coupled to the motor 26, without the use of intervening elements, and extends vertically downward therefrom. A switch 29 is disposed along an outer surface 30 of the handle section 23.

The automatic penetrating mechanism 25 allows a user with limited strength and dexterity to easily secure the apparatus 10 into a ground surface for use. A protective cap 31 is removably positioned over the auger 28 for shielding the auger 28 during transport, and the auger 28 is advantageously rotatable about a fulcrum axis defined along a longitudinal length of the second rod 22. Such a cap 31 protects the auger 28 from damage during transport and storage, and also protects a user from injury that may occur from a user body part coming into undesirable contact with an exposed auger 28.

Yet again referring to FIGS. 1, 2, 3 and 5, the apparatus 10 further includes a mechanism 32 for broadcasting audio signals housed within the second rod 22 and the handle section 23. Such a broadcasting mechanism 32 includes a radio 33 and a speaker 34 electrically coupled thereto. This broadcasting mechanism 32 provides a user with AM/FM radio broadcasts while utilizing the apparatus 10, and allows a user to enjoy audio sounds without having to carry a secondary item.

Figure 5:
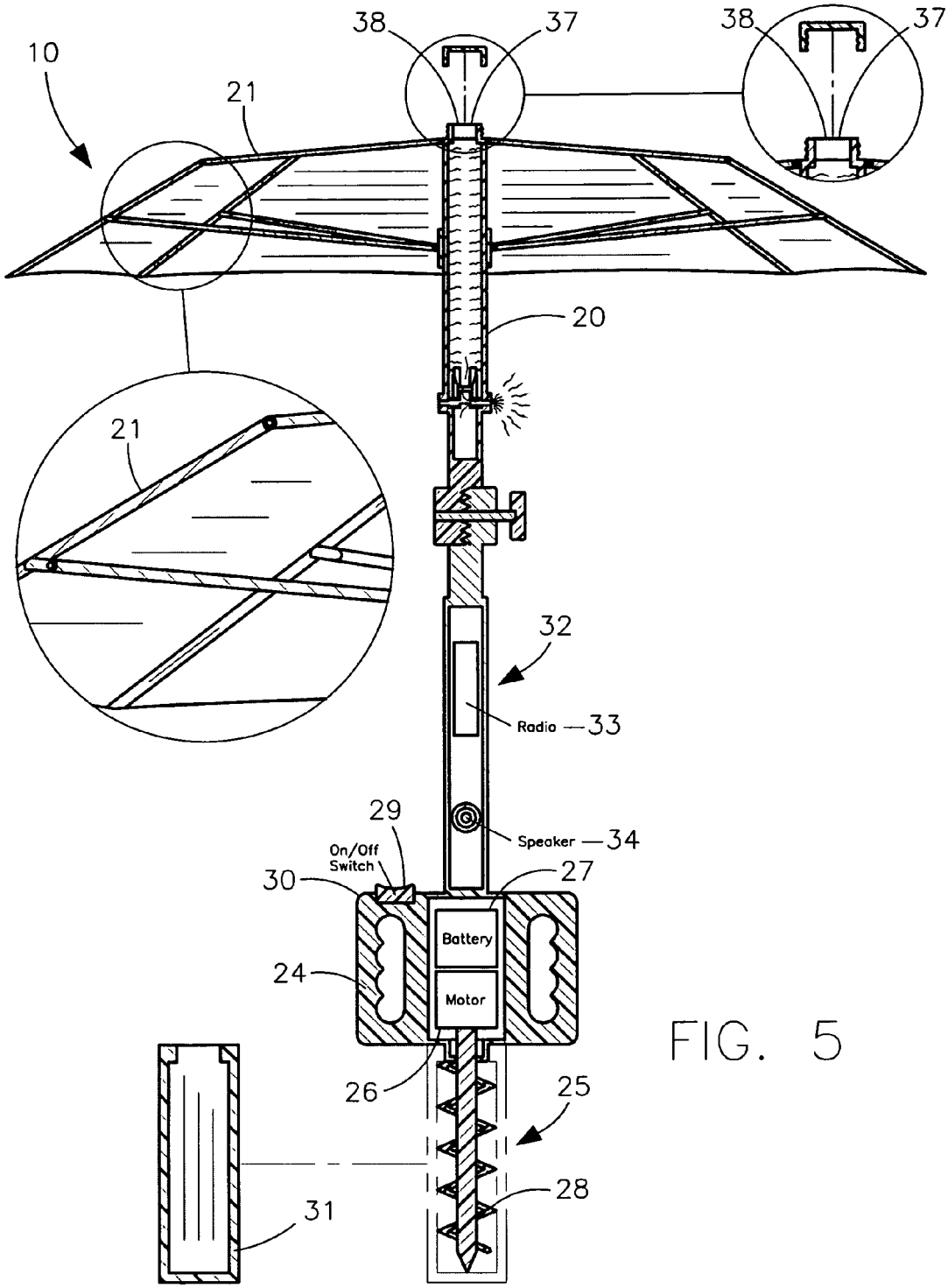
FIG. 5 is a cross sectional view of the apparatus shown in FIG. 1, taken along line 5-5, showing expanded views of the inlet port, the fluid discharging mechanism, and the canopy.
Figure 6:
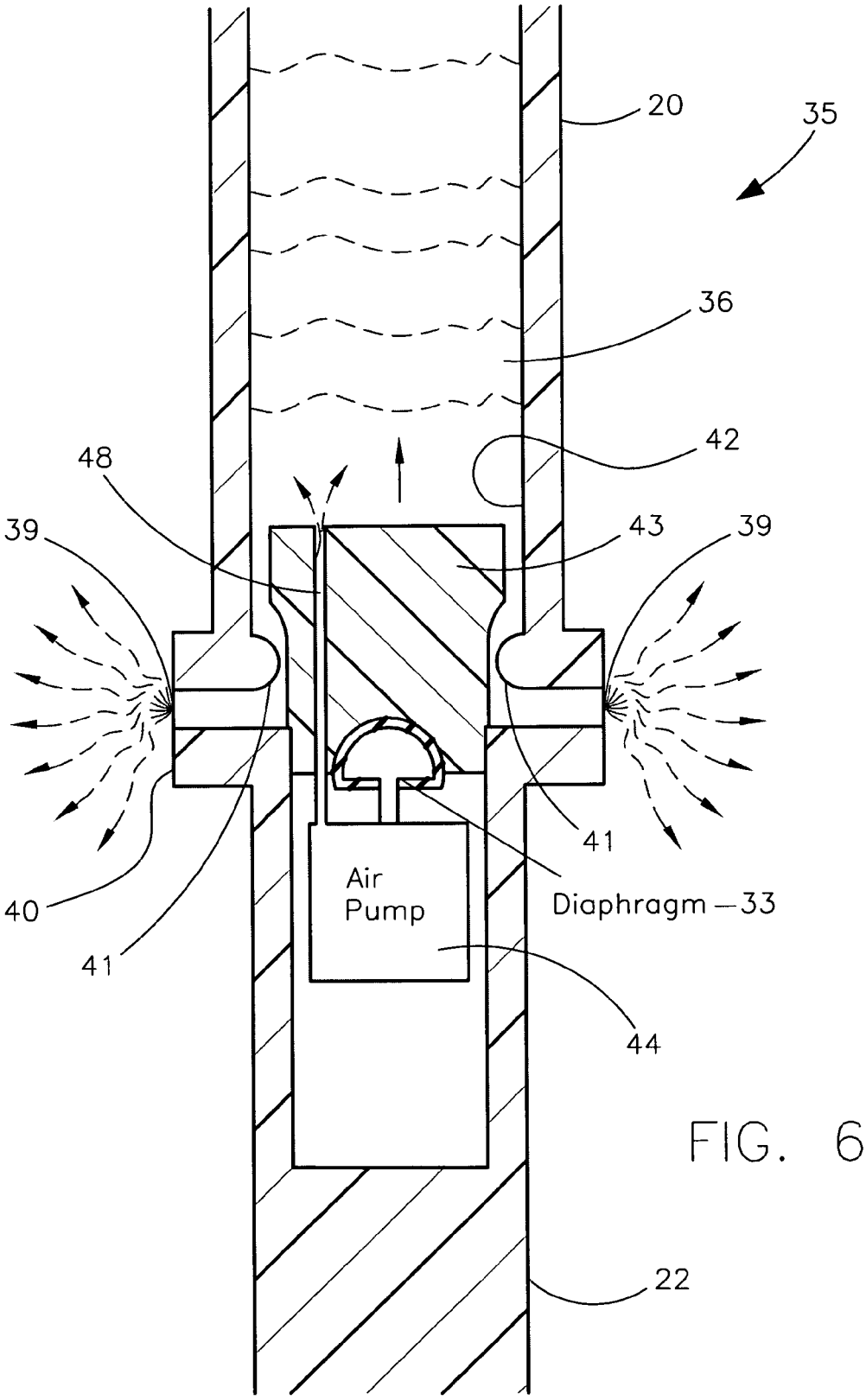
FIG. 6 is an expanded view of the fluid discharging mechanism adapted to an open position.
Figure 7:
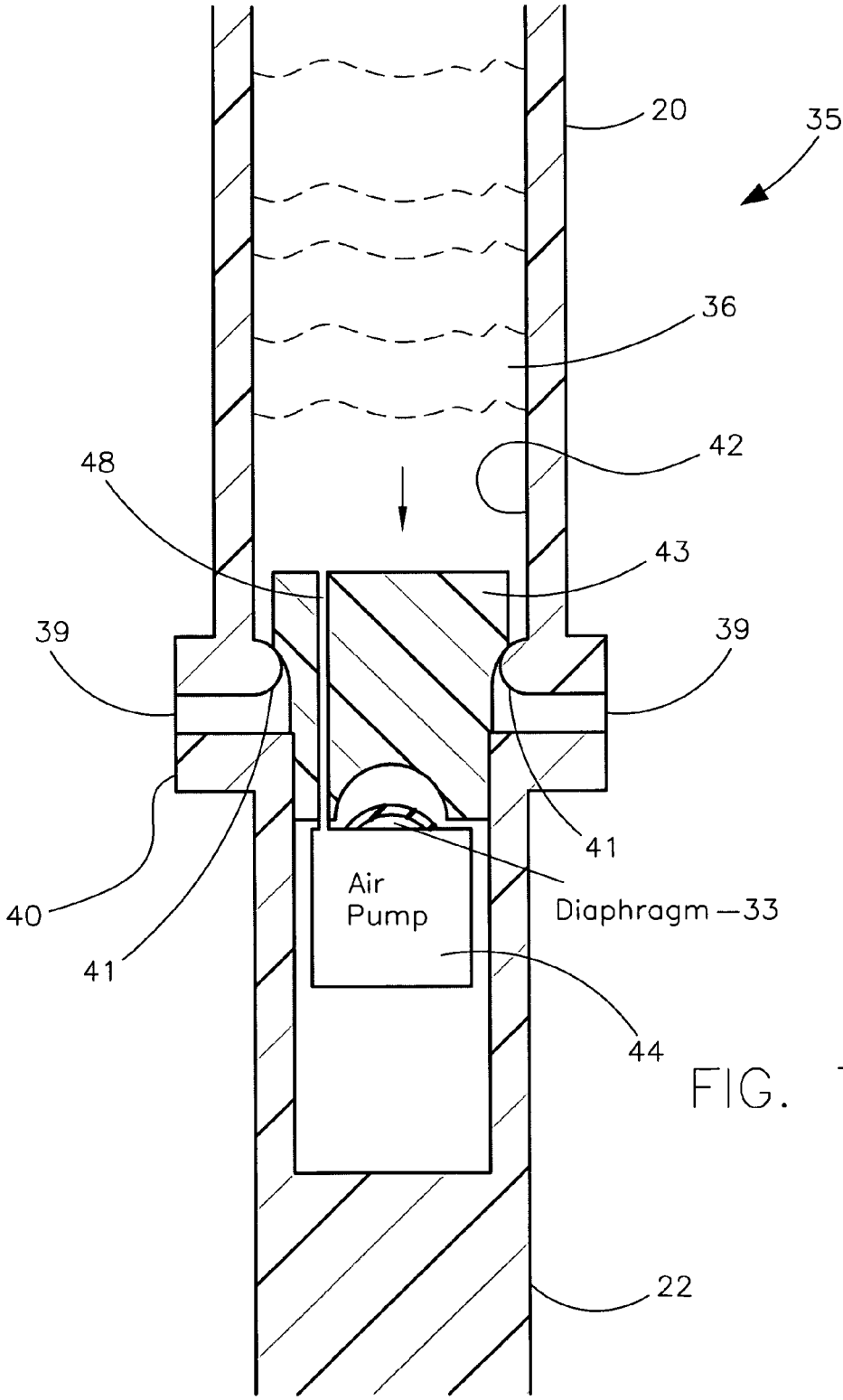
FIG. 7 is an expanded view of the fluid discharging mechanism shown in FIG. 6, showing the stop member preventing fluid from being discharged from the fluid discharging mechanism.

Referring to FIGS. 5, 6 and 7, the apparatus 10 further includes a mechanism 35 for discharging a predetermined quantity of fluid from the first rod 20. The fluid discharging mechanism 35 allows a user to remain cool when outdoors for extended periods of time in heated conditions, and also allows a user to rinse debris from a user body or other objects. Such a fluid discharging mechanism 35 includes a reservoir 36 formed within the first rod 20 and advantageously extending downwardly from an open top end 37 of the first rod 20, which is critical such that the top end 37 defines an inlet port 38 for introducing water into the reservoir 36. A plurality of outlet ports 39 is in fluid communication with the reservoir 36 and disposed along a bottom end 40 thereof. A protrusion 41 is formed along an inner wall 42 of the reservoir 36 and at an entrance of the outlet ports 39, and is located above the outlet ports 39.

A vertically displaceable stop member 43 is linearly positioned within the reservoir 36 and is selectively disengaged from the protrusion 41. An air pump 44 is seated within the first rod 20 and subjacent to the stop member 43, and an inflatable diaphragm 45 is directly coupled to the air pump 44, without the use of intervening elements, and removably abutted directly against a bottom surface of the stop member 43, without the use of intervening elements. The outer edge of the stop member 43 is chamfered and defines an arcuately shaped region that has a flexible diameter adaptable to a corresponding diameter of the protrusions 41, which is critical for advantageously creating a water-tight seal therewith when the diaphragm 45 is deflated. Such a diaphragm 45 is selectively adaptable for receiving a volume of air therein.

The fluid discharging mechanism 35 further includes a conduit 48 directly coupled to the air pump 44, without the use of intervening elements, and passing through the stop member 43. Of course, one skilled in the art understands that the pump 44 is electrically coupled to the battery 27 and is operable via switch 29. Such a switch 29 may be a double-pole, double-throw switch for controlling multiple functions such as the radio and air pump 44, respectively. Such a conduit 48 has a distal end terminating at a top surface of the stop member 43 and within the reservoir 36. The air pump 44 causes the diaphragm 45 to inflate and thereby elevates the stop member 43 a predetermined vertical distance, which is vital such that the outer edges of the stop member 43 advantageously disengage the protrusion 41 and thereby allows the fluid to flow along a downward passageway into the outlet ports 39. Such a downward flow allows a user to selectively discharge fluid as desired. The conduit 48 introduces air into the reservoir 36 and thereby causes the fluid to rapidly discharge outwardly from the outlet ports 39 for creating a mist. The automatic penetrating mechanism 25 and the broadcasting mechanism 32 and the fluid discharging mechanism 35 are simultaneously and independently operable as desired by the user.

In use, the apparatus 10 boasts an integrated spray mister incorporated into the design of the first rod 20. Internally contained within the first rod 20 and positioned directly above the auger 28 and motor 26, without the use of intervening elements, is a length of conduit 48 which serves as a reservoir 36. Another length of conduit 48 is hinge-mounted to the first rod 20 via a wing nut assembly and serves as the actual mister head nozzle. The underside of this nozzle head is covered with a series of outlet ports 39 through which a light spray of water is dispensed. The reservoir 36 is easily filled with water through an inlet port 38 located on the top of the first rod 20.

The combination of the automatic penetrating mechanism 25 and the broadcasting mechanism 32 and the fluid discharging mechanism 35 provides the unexpected benefit of allowing a user to receive shade, mist, and audio sounds through the use of only one apparatus 10. This combination provides convenience, comfort, and efficiency for a user and thereby overcomes the shortcomings of the prior art.

In operation, a method for employing a multi-functional umbrella 10 to provide user enjoyment during inclement weather conditions includes the steps of providing a first rod 20, directly anchoring a collapsible canopy 21 to the first rod 20, without the use of intervening elements, and pivotally attaching a second rod 22 to the first rod 20 in such a manner that the canopy 21 is rotatably pivotal about a fulcrum axis defined orthogonal to the second rod 22, providing a handle section 23 monolithically formed with the second rod 22 and spaced from the first rod 20, and providing a mechanism 25 for automatically penetrating the second rod 22 beneath a ground surface such that the first rod 20 remains statically anchored at a fixed position during operating conditions.

The method further includes the steps of providing a mechanism 32 for broadcasting audio signals, and providing a mechanism 35 for discharging a predetermined quantity of fluid from the first rod 20. The broadcasting mechanism 32 is housed within the second rod 22 and the handle section 23, and includes a radio 33 and a speaker 34 electrically coupled thereto.

The method further includes the steps of providing a reservoir 36 formed within the first rod 20 and extending downwardly from an open top end 37 of the first rod 20 such that the top end 37 defines an inlet port 38 for introducing water into the reservoir 36, providing a plurality of outlet ports 39 in fluid communication with the reservoir 36 and disposed along a bottom end 40 thereof, and providing a protrusion 41 formed along an inner wall 42 of the reservoir 36 and at an entrance of the outlet ports 39. The protrusion 41 is located above the outlet ports 39.

The method further includes the steps of providing a vertically displaceable stop member 43 linearly positioned within the reservoir 36 and selectively disengaged from the protrusion 41, providing an air pump 44 seated within the first rod 20 and subjacent to the stop member 43, providing an inflatable diaphragm 45 directly coupled to the air pump 44, without the use of intervening elements, and removably abutted directly against a bottom surface of the stop member 43, without the use of intervening elements, and providing a conduit 48 directly coupled to the air pump 44 and passing through the stop member 43, without the use of intervening elements. The diaphragm 45 is selectively adaptable for receiving a volume of air therein, and the conduit 48 has a distal end terminating at a top surface of the stop member 43 and within the reservoir 36.

The air pump 44 causes the diaphragm 45 to inflate and thereby elevates the stop member 43 a predetermined vertical distance such that outer edges of the stop member 43 disengage the protrusion 41 and thereby allows the fluid to flow along a downward passageway into the outlet ports 39. The conduit 48 introduces air into the reservoir 36 and thereby causes the fluid to rapidly discharge outwardly from the outlet ports 39 for creating a mist.

The method further includes the steps of providing a motor 26 housed within the handle section 23, providing a power source 27 electrically coupled to the motor 26, providing an auger 28 directly coupled to the motor 26, without the use of intervening elements, and extending vertically downward therefrom, and providing a switch 29 disposed along an outer surface 30 of the handle section 23. The steps further include removably positioning a protective cap 31 over the auger 28 for shielding the auger 28 during transport, and rotating the auger 28 about a fulcrum axis defined along a longitudinal length of the second rod 22. The automatic penetrating mechanism 25 and the broadcasting mechanism 32 and the fluid discharging mechanism 35 are simultaneously and independently operable as desired by the user.

While the invention has been described with respect to a certain specific embodiment, it will be appreciated that many modifications and changes may be made by those skilled in the art without departing from the spirit of the invention. It is intended, therefore, by the appended claims to cover all such modifications and changes as fall within the true spirit and scope of the invention.

In particular, with respect to the above description, it is to be realized that the optimum dimensional relationships for the parts of the present invention may include variations in size, materials, shape, form, function and manner of operation. The assembly and use of the present invention are deemed readily apparent and obvious to one skilled in the art.

What is claimed as new and what is desired to secure by Letters Patent of the United States is:

1. A self-standing multi-functional umbrella for providing user enjoyment during inclement weather conditions, said multi-functional umbrella comprising:

a first rod;

a collapsible canopy directly anchored to said first rod;

a second rod pivotally attached to said first rod in such a manner that said canopy is rotatably pivotal about a fulcrum axis defined orthogonal to said second rod;

a handle section monolithically formed with said second rod and spaced from said first rod;

means for automatically penetrating said second rod beneath a ground surface such that said first rod remains statically anchored at a fixed position during operating conditions;

means for broadcasting audio signals, said broadcasting means being housed within said second rod and said handle section; and means for discharging a predetermined quantity of fluid from said first rod;

wherein said automatic penetrating means and said broadcasting means and said fluid discharging means are simultaneously and independently operable as desired by the user;

wherein said fluid discharging means comprises a reservoir formed within said first rod and extending downwardly from an open top end of said first rod such that said top end defines an inlet port for introducing water into said reservoir;

a plurality of outlet ports in fluid communication with said reservoir and disposed along a bottom end thereof;

a protrusion formed along an inner wall of said reservoir and at an entrance of said outlet ports, said protrusion being located above said outlet ports;

a vertically displaceable stop member linearly positioned within said reservoir and being selectively disengaged from said protrusion;

an air pump seated within said first rod and subjacent to said stop member;

an inflatable diaphragm directly coupled to said air pump and removably abutted directly against a bottom surface of said stop member, said diaphragm being selectively adaptable for receiving a volume of air therein; and a conduit directly coupled to said air pump and passing through said stop member, said conduit having a distal end terminating at a top surface of said stop member and within said reservoir;

wherein said air pump causes said diaphragm to inflate and thereby elevates said stop member a predetermined vertical distance such that outer edges of said stop member disengage said protrusion and thereby allows the fluid to flow along a downward passageway into said outlet ports;

wherein said conduit introduces air into said reservoir and thereby causes the fluid to rapidly discharge outwardly from said outlet ports for creating a mist.

2. The multi-functional umbrella of claim 1, wherein said outer edge of said stop member is chamfered and defines an arcuately shaped region having a flexible diameter adaptable to a corresponding diameter of said protrusions for creating a water-tight seal therewith when said diaphragm is deflated.

3. The multi-functional umbrella of claim 1, wherein said handle section has diametrically offset gripping portions extending perpendicularly away from said second rod.

4. The multi-functional umbrella of claim 1, wherein said automatic penetrating means comprises:

a motor housed within said handle section;

a power source electrically coupled to said motor;

an auger directly coupled to said motor and extending vertically downward therefrom; and a switch disposed along an outer surface of said handle section.

5. The multi-functional umbrella of claim 4, further including a protective cap removably positioned over said auger for shielding said auger during transport;

wherein said auger is rotatable about a fulcrum axis defined along a longitudinal length of said second rod.

6. A self-standing multi-functional umbrella for providing user enjoyment during inclement weather conditions, said multi-functional umbrella comprising:

a first rod;

a collapsible canopy directly anchored to said first rod;

a second rod pivotally attached to said first rod in such a manner that said canopy is rotatably pivotal about a fulcrum axis defined orthogonal to said second rod;

a handle section monolithically formed with said second rod and spaced from said first rod;

means for automatically penetrating said second rod beneath a ground surface such that said first rod remains statically anchored at a fixed position during operating conditions;

means for broadcasting audio signals, said broadcasting means being housed within said second rod and said handle section, wherein said broadcasting means comprises a radio and a speaker electrically coupled thereto; and means for discharging a predetermined quantity of fluid from said first rod;

wherein said automatic penetrating means and said broadcasting means and said fluid discharging means are simultaneously and independently operable as desired by the user;

wherein said fluid discharging means comprises a reservoir formed within said first rod and extending downwardly from an open top end of said first rod such that said ton end defines an inlet port for introducing water into said reservoir;

a plurality of outlet ports in fluid communication with said reservoir and disposed along a bottom end thereof;

a protrusion formed along an inner wall of said reservoir and at an entrance of said outlet ports, said protrusion being located above said outlet ports;

a vertically displaceable stop member linearly positioned within said reservoir and being selectively disengaged from said protrusion;

an air pump seated within said first rod and subjacent to said stop member;

an inflatable diaphragm directly coupled to said air pump and removably abutted directly against a bottom surface of said stop member, said diaphragm being selectively adaptable for receiving a volume of air therein; and a conduit directly coupled to said air pump and passing through said stop member, said conduit having a distal end terminating at a top surface of said stop member and within said reservoir;

wherein said air pump causes said diaphragm to inflate and thereby elevates said stop member a predetermined vertical distance such that outer edges of said stop member disengage said protrusion and thereby allows the fluid to flow along a downward passageway into said outlet ports;

wherein said conduit introduces air into said reservoir and thereby causes the fluid to rapidly discharge outwardly from said outlet ports for creating a mist.

7. The multi-functional umbrella of claim 6 wherein said outer edge of said stop member is chamfered and defines an arcuately shaped region having a flexible diameter adaptable to a corresponding diameter of said protrusions for creating a water-tight seal therewith when said diaphragm is deflated.

8. The multi-functional umbrella of claim 6, wherein said handle section has diametrically offset gripping portions extending perpendicularly away from said second rod.

9. The multi-functional umbrella of claim 6, wherein said automatic penetrating means comprises:

a motor housed within said handle section;

a power source electrically coupled to said motor;

an auger directly coupled to said motor and extending vertically downward therefrom; and a switch disposed along an outer surface of said handle section.

10. The multi-functional umbrella of claim 9, further including a protective cap removably positioned over said auger for shielding said auger during transport;

wherein said auger is rotatable about a fulcrum axis defined along a longitudinal length of said second rod.

11. A method for employing a multi-functional umbrella to provide user enjoyment during inclement weather conditions includes the steps of:

a. providing a first rod;

b. directly anchoring a collapsible canopy to said first rod;

c. pivotally attaching a second rod to said first rod in such a manner that said canopy is rotatably pivotal about a fulcrum axis defined orthogonal to said second rod;

d. providing a handle section monolithically formed with said second rod and spaced from said first rod;

e. providing means for automatically penetrating said second rod beneath a ground surface such that said first rod remains statically anchored at a fixed position during operating conditions;

f. providing means for broadcasting audio signals, said broadcasting means being housed within said second rod and said handle section, wherein said broadcasting means comprises a radio and a speaker electrically coupled thereto; and g. providing means for discharging a predetermined quantity of fluid from said first rod;

wherein said automatic penetrating means and said broadcasting means and said fluid discharging means are simultaneously and independently operable as desired by the user;

wherein step g. comprises the steps of i. providing a reservoir formed within said first rod and extending downwardly from an open top end of said first rod such that said top end defines an inlet port for introducing water into said reservoir;

ii. providing a plurality of outlet ports in fluid communication with said reservoir and disposed along a bottom end thereof;

iii. providing a protrusion formed along an inner wall of said reservoir and at an entrance of said outlet ports, said protrusion being located above said outlet ports;

iv. providing a vertically displaceable stop member linearly positioned within said reservoir and being selectively disengaged from said protrusion;

v. providing an air pump seated within said first rod and subjacent to said stop member;

vi. providing an inflatable diaphragm directly coupled to said air pump and removably abutted directly against a bottom surface of said stop member, said diaphragm being selectively adaptable for receiving a volume of air therein; and vii. providing a conduit directly coupled to said air pump and passing through said stop member, said conduit having a distal end terminating at a top surface of said stop member and within said reservoir;

wherein said air pump causes said diaphragm to inflate and thereby elevates said stop member a predetermined vertical distance such that outer edges of said stop member disengage said protrusion and thereby allows the fluid to flow along a downward passageway into said outlet ports;

wherein said conduit introduces air into said reservoir and thereby causes the fluid to rapidly discharge outwardly from said outlet ports for creating a mist.

12. The method of step 11, wherein said outer edge of said stop member is chamfered and defines an arcuately shaped region having a flexible diameter adaptable to a corresponding diameter of said protrusions for creating a water-tight seal therewith when said diaphragm is deflated.

13. The method of step 11, wherein said handle section has diametrically offset gripping portions extending perpendicularly away from said second rod.

14. The method of step 11, wherein said step e. comprises the steps of:

i. providing a motor housed within said handle section;

ii. providing a power source electrically coupled to said motor;

iii. providing an auger directly coupled to said motor and extending vertically downward therefrom; and iv. providing a switch disposed along an outer surface of said handle section.

15. The method of step 14, further comprising the steps of:

h. removably positioning a protective cap over said auger for shielding said auger during transport; and i. rotating said auger about a fulcrum axis defined along a longitudinal length of said second rod.

* * * * *